US007534113B2

(12) United States Patent
Liao et al.

(10) Patent No.: US 7,534,113 B2
(45) Date of Patent: May 19, 2009

(54) ELECTRICAL CONTACT BACKGROUND OF THE INVENTION

(75) Inventors: Fang-Jun Liao, Tu-Cheng (TW); Wen-Chun Chen, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/986,803

(22) Filed: Nov. 26, 2007

(65) Prior Publication Data

US 2008/0124957 A1 May 29, 2008

(51) Int. Cl.
*H01R 12/00* (2006.01)

(52) U.S. Cl. ..... 439/83; 439/862

(58) Field of Classification Search ..... 439/83, 439/342, 862, 66, 874, 876
See application file for complete search history.

(56) References Cited

U.S. PATENT DOCUMENTS

| | | | | |
|---|---|---|---|---|
| 6,155,845 | A * | 12/2000 | Lin et al. | 439/83 |
| 6,623,283 | B1 * | 9/2003 | Torigian et al. | 439/83 |
| 7,226,298 | B1 * | 6/2007 | Minich | 439/83 |
| 2003/0114029 | A1 * | 6/2003 | Lee et al. | 439/83 |
| 2006/0094268 | A1 * | 5/2006 | Hao | 439/83 |
| 2006/0105598 | A1 * | 5/2006 | Hao | 439/83 |

* cited by examiner

*Primary Examiner*—Hien Vu
(74) *Attorney, Agent, or Firm*—Wei Te Chung

(57) ABSTRACT

A conduct (3) includes a retention portion (31), a contacting portion (334) extending upwardly from the retention portion (3), a tail portion (34) formed on a distal end of the retention portion. The tail portion (34) has a relatively larger bottom surface vertical to the major surface of the base defining a multilateral-shaped recess (340) adapted to engage a solder member, e.g. solder ball, thereby establishing electrical engagement between the contact and the PCB.

6 Claims, 4 Drawing Sheets

ELECTRICAL CONTACT BACKGROUND OF THE INVENTION

BACKGROUND OF THE INVENTION

1. Field of the Invention

The present invention generally relates to the field of electrical connectors. And more particularly, one embodiment of the present invention relates to a conductive contact for connecting a chip module to a printed circuit board.

2. General Background

Electrical conductive contact are widely used in various computer systems connectors for forming electrical connection between two separate electrical interfaces, such as an electronic component and a printed circuit board. Referring to FIGS. 1-2, the conductive terminal 1 includes a vertical securing section 11, a connecting portion extending from the securing section 11, a contacting portion disposed on a top end of the connecting portion, a tail portion 13 extending from a lower end of the securing portion 32. The tail portion 13 defines a recess 130 with a circular shape on a bottom surface facing the printed circuit board for propositioning the solder ball 20 therein.

However, the abovementioned terminal lies in following drawbacks: the circular shaped recess 130 for receiving the solder ball 20 is abutting against the surface of the solder ball, there are not spared space therebetween. The ball planted generally has cavities 21 therein for the solder flux is not easy to volatilize when the contact 1 is planed with solder ball 20.

Therefore, there is a heretofore unaddressed need in the industry to address the aforementioned deficiencies and inadequacies.

SUMMARY

According to an embodiment of the present invention, a conduct includes a retention portion, a contacting portion extending upwardly from the retention portion, a tail portion formed on a distal end of the retention portion. The tail portion has a relatively larger bottom surface vertical to the major surface of the base defining a multilateral-shaped recess adapted to engage a solder member, e.g. solder ball, thereby establishing electrical engagement between the contact and the PCB.

In relative to the conventional technology, the electrical connector defines a tail portion defining a multilateral-shaped recess on the bottom surface thereof, hence improving a flaw that the terminals can incur the solder area with vacancy between the tail portion and the solder ball. Furthermore, a reliable engagement between the contact and the printed circuit board is attained, and the stable electrical and mechanical connection therebetween can be assured.

The present invention is illustrated by way of example and not limitation in the figures of the appended drawings, in which like references indicate identical elements, and in which:

DETAILED DESCRIPTION OF THE EMBODIMENTS

In the following description, for purpose of explanation, numerous details are set forth in order to provide a thorough understanding of the embodiments of the present invention. However, it will be apparent to one skilled in the art that these specific details are not required in order to practice the embodiments of the present invention.

The following description includes terms such as upper, lower, upwardly and the like, that are used for descriptive purpose only and are not to be construed as limiting. That is, these terms are terms that are relative only to a point of reference and are not meant to be interpreted as limitation but are instead, included in the following description to facilitate understanding of the various aspects of the present invention.

Figure 1:
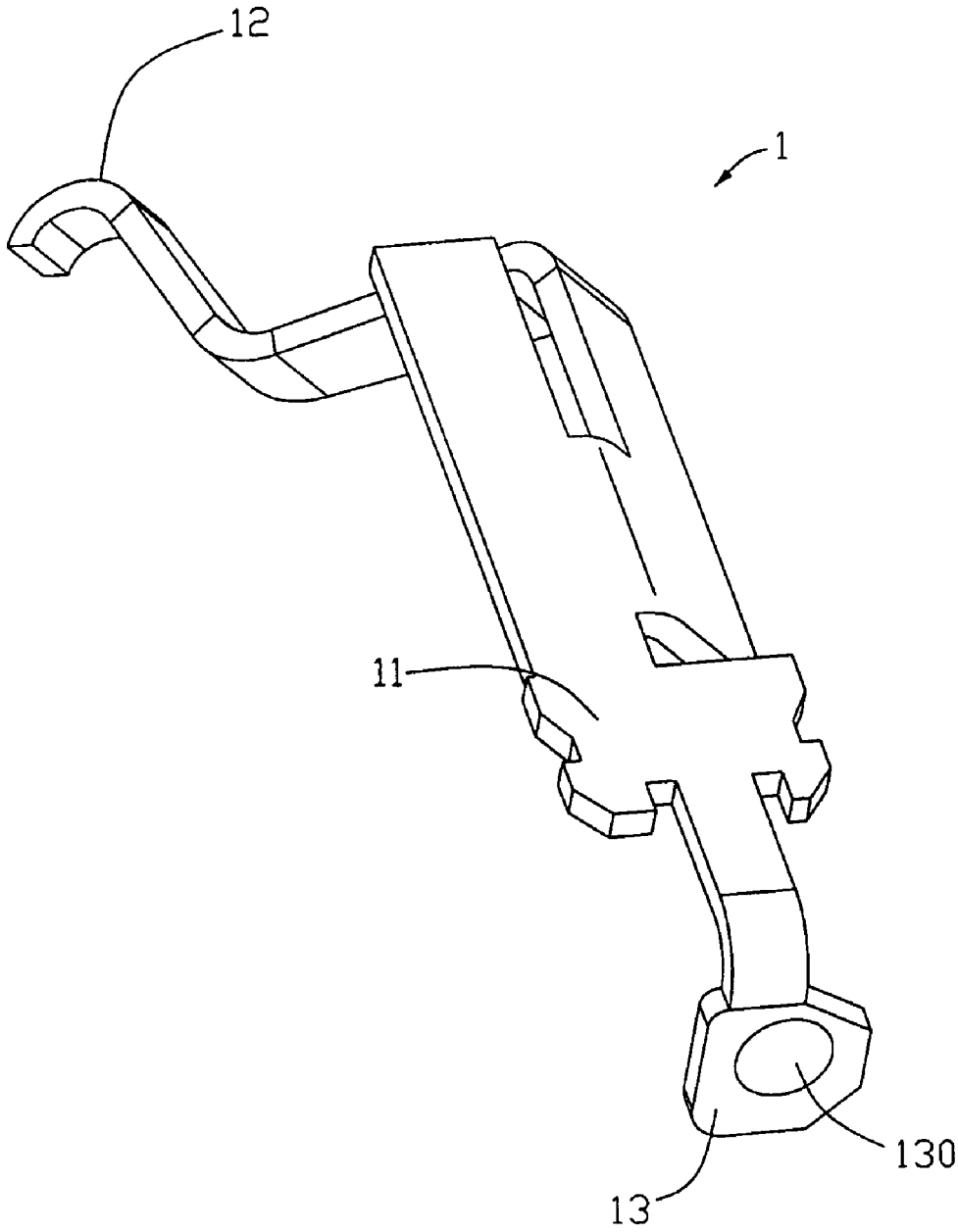
FIG. 1 depicts an exemplary isometric view of a conventional electrical contact.
Figure 2:
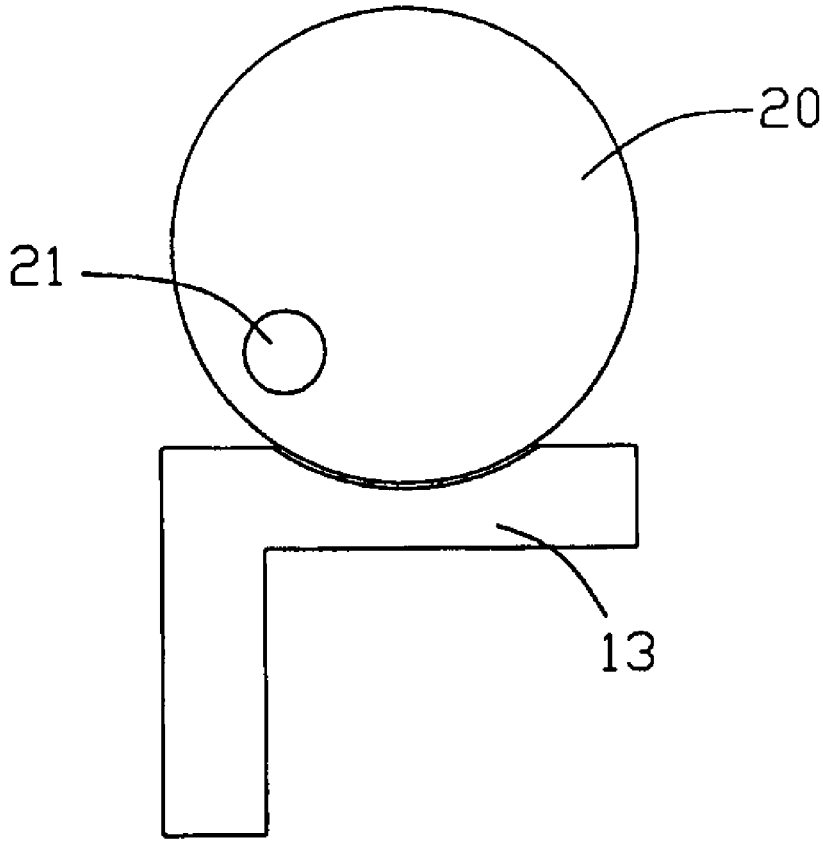
FIG. 2 depicts an assembled view of a conductive contact shown in FIG. 1 and a solder ball, when the contact is planted with the solder ball.
Figure 3:
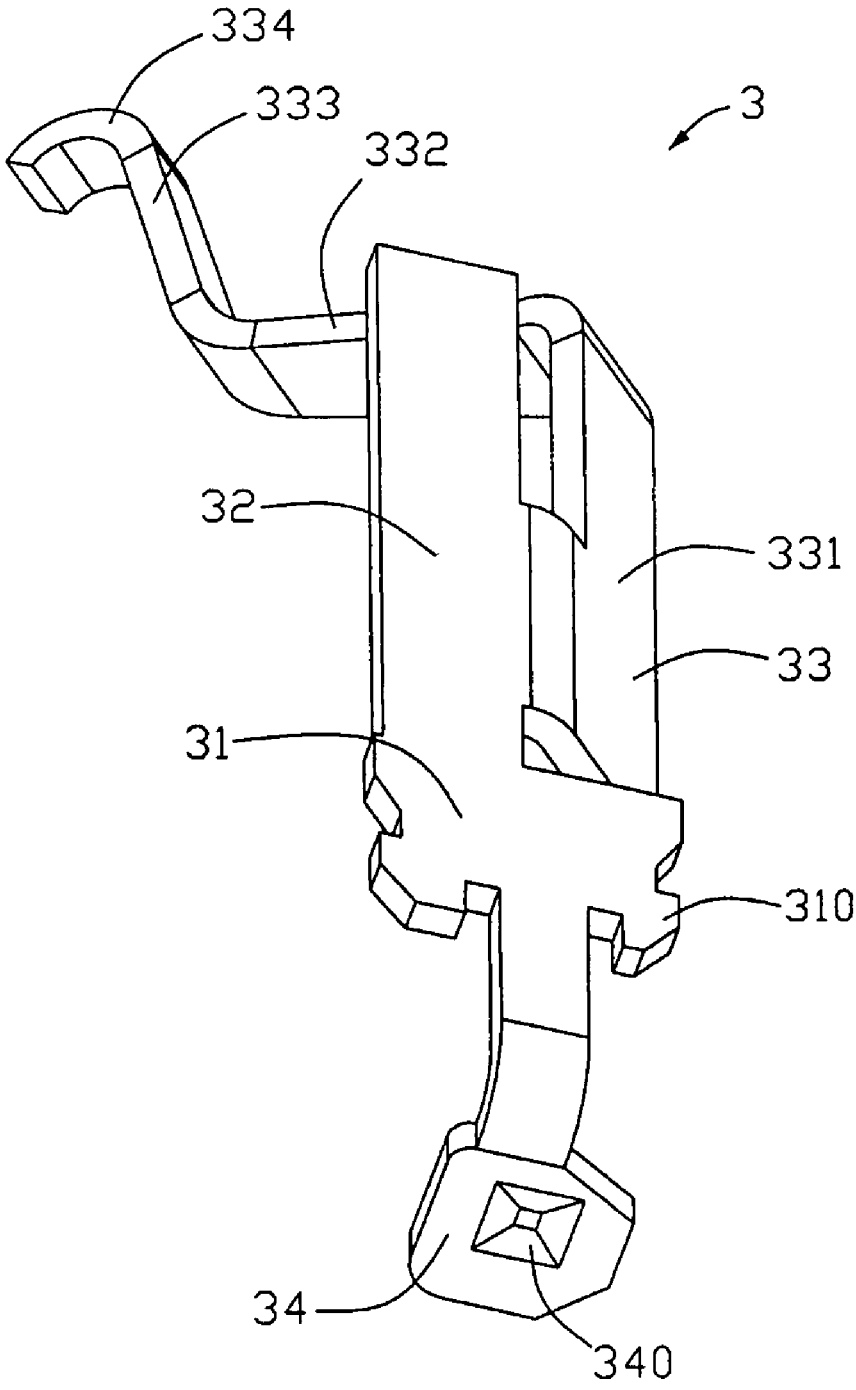
FIG. 3 depicts an exemplary isometric view of an electrical contact.
Figure 4:
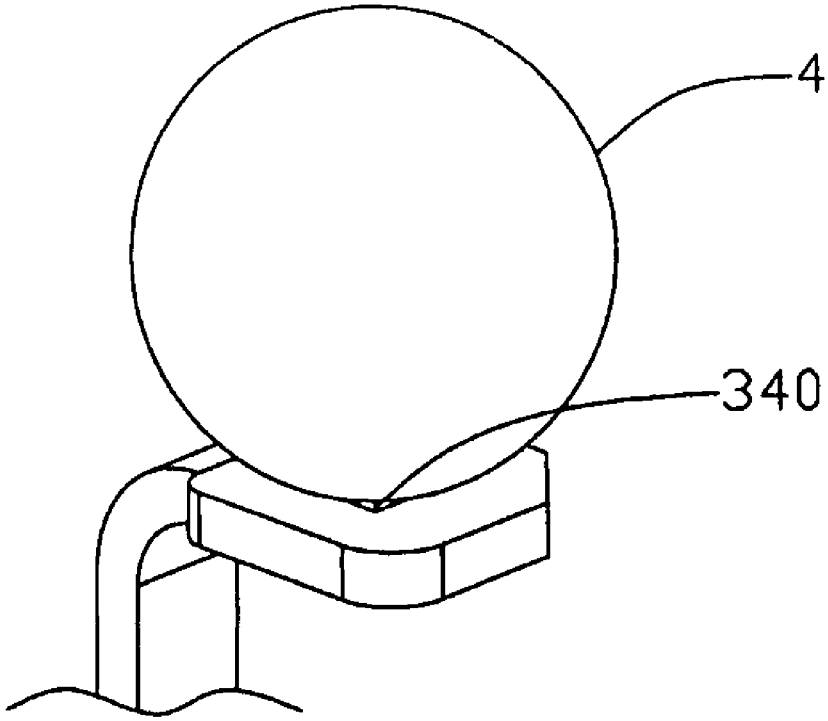
FIG. 4 depicts an assembled view of a conductive contact shown in FIG. 1 and a solder ball, when the contact is planted with the solder ball.

Referring also to FIGS. 3-4, the contact 3 is formed from conductive material and has a vertical plate-like retention portion 31 having a number of interfering blocks 310 at two lateral sides thereof for securing in a corresponding passageway of the socket generally with a symmetrical central line (not labeled).

Referring also to FIG. 4, for more reliable position of the contact 3 in the passage of a socket, an upright head portion 32 extends from a top end of the retention portion 31. In this preferred embodiment, the head portion 32 is coplanar with the retention portion 31 and has a generally elongate plate-like configuration. It should be understood that the head portion 32 may be figured to have other configurations, as long as it can be fit for fixing the contact 3 more reliably in the socket.

A horizontal tail portion 34 bends from a bottom edge of the retention portion 31. The tail portion 34 is substantially perpendicular to the retention portion 31 and has a relatively larger bottom surface (not numbered) vertical to the major surface of the retention portion 31. The tail portion 34 is used to establish electrical connecting between the contact 3 and the PCB via a corresponding solder member, e.g. a solder ball (not shown). The tail portion 34 has a relatively larger bottom surface vertical to the major surface of the base defining a multilateral-shaped recess 330 adapted to engage a solder member, e.g. solder ball, thereby establishing electrical engagement between the contact 3 and the PCB.

A spring arm 33 extends from a side edge of the head portion 32. Specially, an acute angle is formed between the head portion 32 and the spring arm 33. The spring arm 33 comprises a body portion 331 extending from and connecting with the head portion 32, an extending portion 332 extending upwardly from the body portion 331 with a slightly angle and spaced with the head portion 32, a stretching portion 333 extending curved from a top end of the extending portion 332.

The contact 1 further has a contacting portion 334 formed at a distal end of the spring arm 33, being at a topmost part of the contact 3, for electrically engagingly mating with a corresponding conductive pad of the IC package. In this preferred embodiment, the contacting portion 334 has an arced or curved configuration.

In use, the contact 3 is received in an insulative housing of the socket which serves to electrically connect the IC package and the PCB. The soldering portion 34 is electrically soldered to the PCB. The spring arm 33 produces resilient deformation by an exterior force acted on the contact 3. The contacting portion 334 urges and mates with a corresponding conductive pad of the IC package through elastic force generated by the resilient deformation of the spring arm 33. Thus, electrical connecting between the IC package and the PCB is established.

In connection with the preceding description, the electrical connectors in accordance with embodiments of the present invention defines a tail portion 34 having a multilateral-shaped recess 340 adapted to engage a solder member/ball 4, which provides an effect space for the solder flux volatilizing when the tail portion is soldered to the printed circuit, hence improving a flaw that the contacts 3 can incur the solder area with vacancy of the solder ball 4 planted. Furthermore, a reliable engagement between the contacts 3 and the printed circuit board is attained, and the stable electrical and mechanical connection therebetween can be assured, which possibly optimize electrical and mechanical connection. It can be understood that in this embodiment the solder ball 4 is round and the recess is essentially a polygon, e.g., the square, which is not compliant with the boundary of the solder ball 4 on the interface therebetween, i.e., the undersurface of the tail portion 34, so the intersected right angle between every adjacent two sides of the square can be exposed to an exterior to allow vaporization during fusing the solder ball 4 to the tail portion 34.

While the present invention has been illustrated by description of embodiments thereof, and while the embodiments have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

What is claimed is:

1. An electrical contact comprising:

a retention portion;

a tail portion extending downwardly from a lower portion of the retention portion and being adapted for electrically engaging with an electrical component, a solder portion defining a multilateral-shaped recess on a bottom surface thereof for receiving a solder ball therein;

a head portion extending upwardly from and coplanar with the retention portion;

a spring arm extending from the head portion and spatially arranged with respect to the retention portion;

wherein when a solder ball is receiving in said multilateral-shaped recess, a channel being formed between inner surface and a surface of the solder ball and communicating with the outer space, said channel allows the vaporized flux material to be laterally dissipated through the channel, during the reflowable process wherein the spring arm is angled an acute angle with the head portion;

wherein said inner surface of the multilateral-shaped recess comprising several planes and curved surface;

wherein dimension of the recess is gradually increases from bottom portion, which is away from the bottom surface of the solder portion, to upper potion located at the bottom surface of the solder portion.

2. The electrical contact as claimed in claim 1, wherein the spring arm comprises a body portion, an extending portion extending from the body portion, a stretching portion extending from a top end of the extending portion.

3. The electrical contact as claimed in claim 1, wherein the spring arm extends from a sidewall of the head portion and a space is defined between the spring arm and the retention portion.

4. The electrical contact as claimed in claim 3, wherein the body portion is spaced disposed with the head portion.

5. The electrical contact as claimed in claim 4, wherein further comprising a contacting portion defined on a top end of the spring arm.

6. The electrical connector as claimed in claim 1, wherein said recess does not extend upwardly through said solder portion and a closed type boundary of said recess is located fully within a periphery of said bottom surface.

* * * * *